US010016693B1

(12) United States Patent
Dowdy et al.

(10) Patent No.: US 10,016,693 B1
(45) Date of Patent: Jul. 10, 2018

(54) HANDHELD SPINNER TOY WITH STATIONERY ITEM

(71) Applicant: Raymond Geddes & Company, Inc., Baltimore, MD (US)

(72) Inventors: Destiny Lynn Dowdy, Sykesville, MD (US); Cesar Peñaflor Castillo, Jr., Timonium, MD (US)

(73) Assignee: Raymond Geddes & Company, Inc., Baltimore, MD (US)

( * ) Notice: Subject to any disclaimer, the term of this patent is extended or adjusted under 35 U.S.C. 154(b) by 0 days.

(21) Appl. No.: 15/585,938

(22) Filed: May 3, 2017

(51) Int. Cl.

| | |
|---|---|
| ***A63H 1/00*** | (2006.01) |
| ***A63H 33/00*** | (2006.01) |
| ***A63H 29/08*** | (2006.01) |
| ***B43K 29/00*** | (2006.01) |
| ***B43K 27/08*** | (2006.01) |

(52) U.S. Cl.
CPC ..... *A63H 33/003* (2013.01); *A63H 1/00* (2013.01); *A63H 29/08* (2013.01); *B43K 27/08* (2013.01); *B43K 29/00* (2013.01)

(58) Field of Classification Search
CPC ..... A63H 1/00; A63H 33/002; A63H 33/40; A47B 49/00; B43L 19/0056; B43L 19/0068
USPC ..... D21/455
See application file for complete search history.

(56) References Cited

U.S. PATENT DOCUMENTS

D148,698 S * 2/1948 Hanes ..... D21/455
3,428,380 A * 2/1969 Danjczek ..... B43M 99/007 206/371
3,592,511 A * 7/1971 Hudelson ..... B62D 55/0966 152/393
4,012,864 A * 3/1977 Lister ..... A63H 33/002 446/219
D260,911 S * 9/1981 Anderson ..... D21/455
4,913,940 A * 4/1990 Pratt ..... G09F 17/00 428/7
5,009,336 A * 4/1991 Liaw ..... A47F 5/02 206/214

(Continued)

OTHER PUBLICATIONS

"Fidget Spinners are the Must Have Toy for 2017", Forbes Magazine, Dec. 23, 2016.*

(Continued)

*Primary Examiner* — John Ricci
(74) *Attorney, Agent, or Firm* — Sterne, Kessler, Goldstein & Fox P.L.L.C.

(57) ABSTRACT

A handheld spinner includes a housing, a holder, a ball bearing, and a stationery item. The stationery item is disposed on the housing and includes a pencil, a pen, a marker, a highlighter, a crayon, a brush, a stylus, a stamper, an eraser, and/or chalk. The ball bearing is disposed in the holder and the holder is disposed in the housing. In one embodiment, the handheld spinner includes a cap disposed on the holder and the ball bearing. In one embodiment, the handheld spinner includes a holder, a ball bearing, and a stationery item. In one embodiment, the stationery item is a plurality of stationery items spaced apart by discrete angles. A user rotates the handheld spinner about the rotational axis of the ball bearing, which spins the stationery item or items. The handheld spinner is useful as a fidget toy and houses multiple stationery items on a single device.

21 Claims, 9 Drawing Sheets

(56) References Cited

U.S. PATENT DOCUMENTS

| | | | | | |
|---|---|---|---|---|---|
| 5,067,923 | A * | 11/1991 | de Bourbon | A63H 33/18 | 434/258 |
| 5,209,692 | A * | 5/1993 | Coleman | A23G 3/50 | 40/411 |
| 5,318,293 | A * | 6/1994 | Nathanson | A63H 1/00 | 446/236 |
| 5,591,062 | A * | 1/1997 | Hettinger | A63B 67/086 | 446/240 |
| 5,617,658 | A * | 4/1997 | Chen | G09F 19/08 | 40/411 |
| 6,457,593 | B1 * | 10/2002 | Hsu | A47F 5/02 | 211/163 |
| 7,104,196 | B1 | 9/2006 | Fong et al. | | |
| 7,179,149 | B2 * | 2/2007 | Chernick | A63H 33/22 | 417/234 |
| 7,361,075 | B1 | 4/2008 | Krull | | |
| 8,257,135 | B2 * | 9/2012 | Arcovio | A63H 37/00 | 446/242 |
| 9,914,063 | B1 * | 3/2018 | McCoskery | A63H 29/08 | |
| 2015/0367246 | A1 * | 12/2015 | Qiu | A01D 34/001 | 446/236 |

OTHER PUBLICATIONS

DIY $2 or less Plastic Pipe Hand Spinners—Fidget Spinners Video, published by Mike Meyers on YouTube, Jan. 16, 2017. Retrieved Mar. 1, 2017. https://www.youtube.com/watch?v=CnHod4r0oA8.

How to make spinning top from ERASER | DIY | 2016 Video, published by GearsForBrain on YouTube, May 31, 2016. Retrieved Mar. 1, 2017. https://www.youtube.com/watch?v=ALCROWnp63I.

* cited by examiner

HANDHELD SPINNER TOY WITH STATIONERY ITEM

BACKGROUND

Field

The present disclosure relates to a handheld spinner toy. More specifically, embodiments of the present disclosure relate to a handheld spinner with a stationery item or multiple stationery items.

Background

A fidget spinner is a type of toy to alleviate stress or excess energy and aid fidgeting of the user. Fidgeting may result from nervousness, boredom, or a disorder such as attention deficit hyperactivity disorder (ADHD) or autism. Devices exist to help aid fidgeting, such as fidget cubes, allowing the user to focus and pay attention more easily. Specifically, studies have shown that students may benefit from playing with fidget toys and pay more attention to what is being taught.

BRIEF SUMMARY

In some embodiments, a handheld spinner includes a housing having an aperture disposed in the housing, a holder including a first insert and a second insert disposed in the aperture, a ball bearing disposed between the first insert and the second insert in the holder, and a stationery item disposed on the housing. In some embodiments, the aperture is circular. In some embodiments, the first insert includes a first radial wall and a first flange that extends from one end of the first radial wall. In some embodiments, the second insert includes a second radial wall and a second flange that extends from one end of the second radial wall.

In some embodiments, the stationery item is selected from the group consisting of a pencil, a pen, a marker, a highlighter, a crayon, a brush, a stylus, a stamper, an eraser, and chalk. In some embodiments, the stationery item is a plurality of stationery items disposed on the housing. In some embodiments, the plurality of stationery items are spaced apart by an angle of about N, where N=180 degrees, 120 degrees, 90 degrees, 72 degrees, 60 degrees, 45 degrees, 36 degrees, or 30 degrees.

In some embodiments, the handheld spinner includes a first plurality of ribs formed on the first radial wall for press fit holding the ball bearing in the holder and a second plurality of ribs formed on the second radial wall for press fit holding the ball bearing in the holder. In some embodiments, the first insert and the second insert are symmetric.

In some embodiments, the handheld spinner includes a notch formed in the circular aperture and a locking nub formed on the second insert, which is coupled to the locking nub when the holder is disposed in the circular aperture of the housing. In some embodiments, the first insert and the second insert are interlocked with each other.

In some embodiments, a handheld spinner includes a housing having an aperture disposed in the housing, a holder disposed in the aperture, a ball bearing disposed in the holder, and a stationery item disposed on the housing. In some embodiments, the holder includes a radial wall. In some embodiments, the holder includes a plurality of ribs formed on the inside of the radial wall for press fit holding the ball bearing. In some embodiments, the holder includes a flange attached to the radial wall that extends from one end of the radial wall and engages with the housing. In some embodiments, the radial wall of the holder includes a locking nub and the aperture disposed in the housing includes a notch, which is coupled to the locking nub when the holder is disposed in the aperture of the housing.

In some embodiments, the holder comprises a first insert and a second insert. In some embodiments, the first insert and the second insert are symmetric. In some embodiments, the first insert and the second insert are interlocked with each other.

In some embodiments, the stationery item is selected from the group consisting of a pencil, a pen, a marker, a highlighter, a crayon, a brush, a stylus, a stamper, an eraser, and chalk. In some embodiments, the stationery item is a plurality of stationery items disposed on the housing. In some embodiments, the plurality of stationery items are spaced apart by an angle of about N, where N=180 degrees, 120 degrees, 90 degrees, 72 degrees, 60 degrees, 45 degrees, 36 degrees, or 30 degrees.

In some embodiments, a handheld spinner includes a holder, a ball bearing disposed in the holder, and a stationery item disposed on the holder. In some embodiments, the stationery item is selected from the group consisting of a pencil, a pen, a marker, a highlighter, a crayon, a brush, a stylus, a stamper, an eraser, and chalk. In some embodiments, the stationery item is a plurality of stationery items disposed on the holder, and wherein the plurality of stationery items are spaced apart by an angle of about N, where N=180 degrees, 120 degrees, or 90 degrees. In some embodiments, the stationery item is a writing implement.

In some embodiments, a handheld spinner includes a cap disposed on the housing and covering the ball bearing in the aperture. In some embodiments, the cap includes an upper cap and a lower cap. In some embodiments, the upper cap and the lower cap are interlocking.

In some embodiments, a handheld spinner includes two locking nubs and the aperture in the housing includes two notches, which are coupled to the locking nubs when the holder is disposed in the aperture of the housing.

BRIEF DESCRIPTION OF THE DRAWINGS

The accompanying drawings, which are incorporated herein and form a part of the specification, illustrate the embodiments and, together with the description, further serve to explain the principles and to enable a person skilled in the relevant art(s) to make and use the embodiments. Objects and advantages of illustrative, non-limiting embodiments will become more apparent by describing them in detail with reference to the attached drawings.

Figure 1:
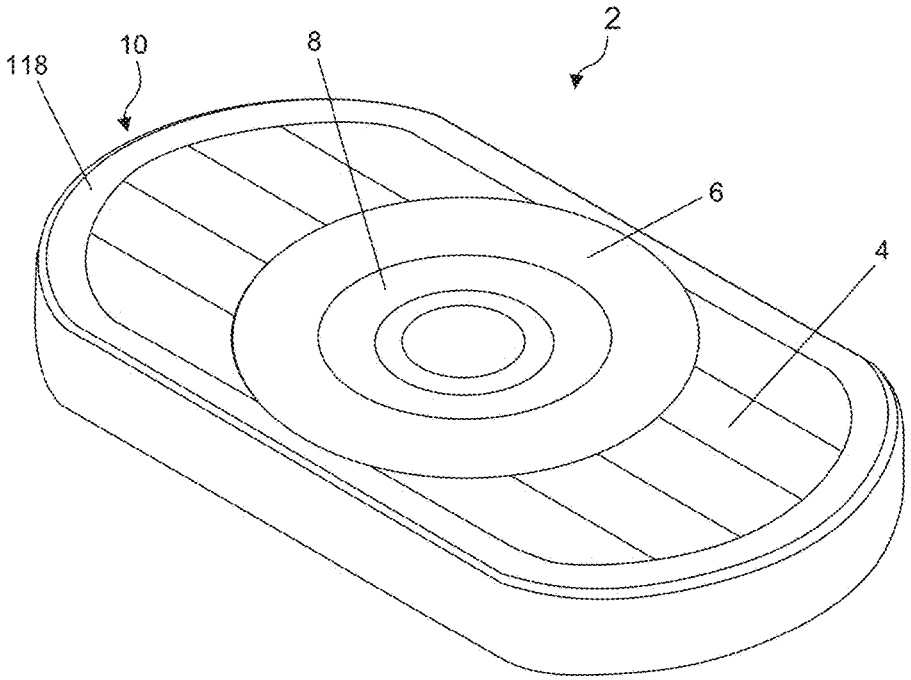
FIG. 1 illustrates a side perspective view of a handheld spinner with a stationery item (e.g., eraser), according to an embodiment.

The features and advantages of the embodiments will become more apparent from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION

Embodiments of the present disclosure are described in detail with reference to embodiments thereof as illustrated in the accompanying drawings. References to "one embodiment," "an embodiment," "some embodiments," etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present embodiments. Other suitable modifications and adaptations of the variety of conditions and parameters normally encountered in the field, and which would be apparent to those skilled in the art, are within the spirit and scope of the disclosure.

Ball bearings have been used by humans for hundreds of years and are well known in mechanics. Generally, ball bearings contain lubricated spherical balls that roll between a grooved inner ring and a grooved outer ring with minimal friction. The grooves are designed such that the balls contact the rings at a single point. The outer ring or the inner ring may be held stationary depending on the particular application. When one ring is held stationary, the other is free to rotate clockwise or counter-clockwise due to the lubricated balls and very low torque of the system. Additional components can include a cage or retainer for the lubricated spherical balls as well as a thin metal shield pressed into a small groove on an inside edge of the outer ring to protect the rolling balls.

Fidget spinners are used to help children and adults alleviate stress or excess energy and better cope with nervousness, boredom, or a disorder (e.g., ADHD, autism, etc.) by gripping a ball bearing disposed in a handheld spinner and rotating the spinner body about the rotational axis of the ball bearing. Specifically, a user of the handheld spinner can grip, for example, with his/her index finger and thumb, an inner ball bearing cylinder (i.e., inner ring) and then freely rotate an outer ball bearing radial wall (i.e., outer ring), thus, rotating the handheld spinner and one or more stationery items disposed on the spinner body in unison, clockwise or counter-clockwise, about a rotational axis of the ball bearing. A handheld spinner toy with a stationery item including a writing implement (e.g., such as a pencil, pen, marker, highlighter, crayon, brush, stylus, stamper, eraser, chalk, etc.) provides an added benefit for adults as well as children to help focus their attention and deter fidgeting, and provides a useful article as part of the spinner. The herein described handheld spinner is useful not only as a fidget toy but also includes a stationery item or multiple different stationery items on a single device, which is particularly useful for children performing school activities and adults at work. Embodiments of the handheld spinner toy with one or more stationery items are described herein.

Figure 2:
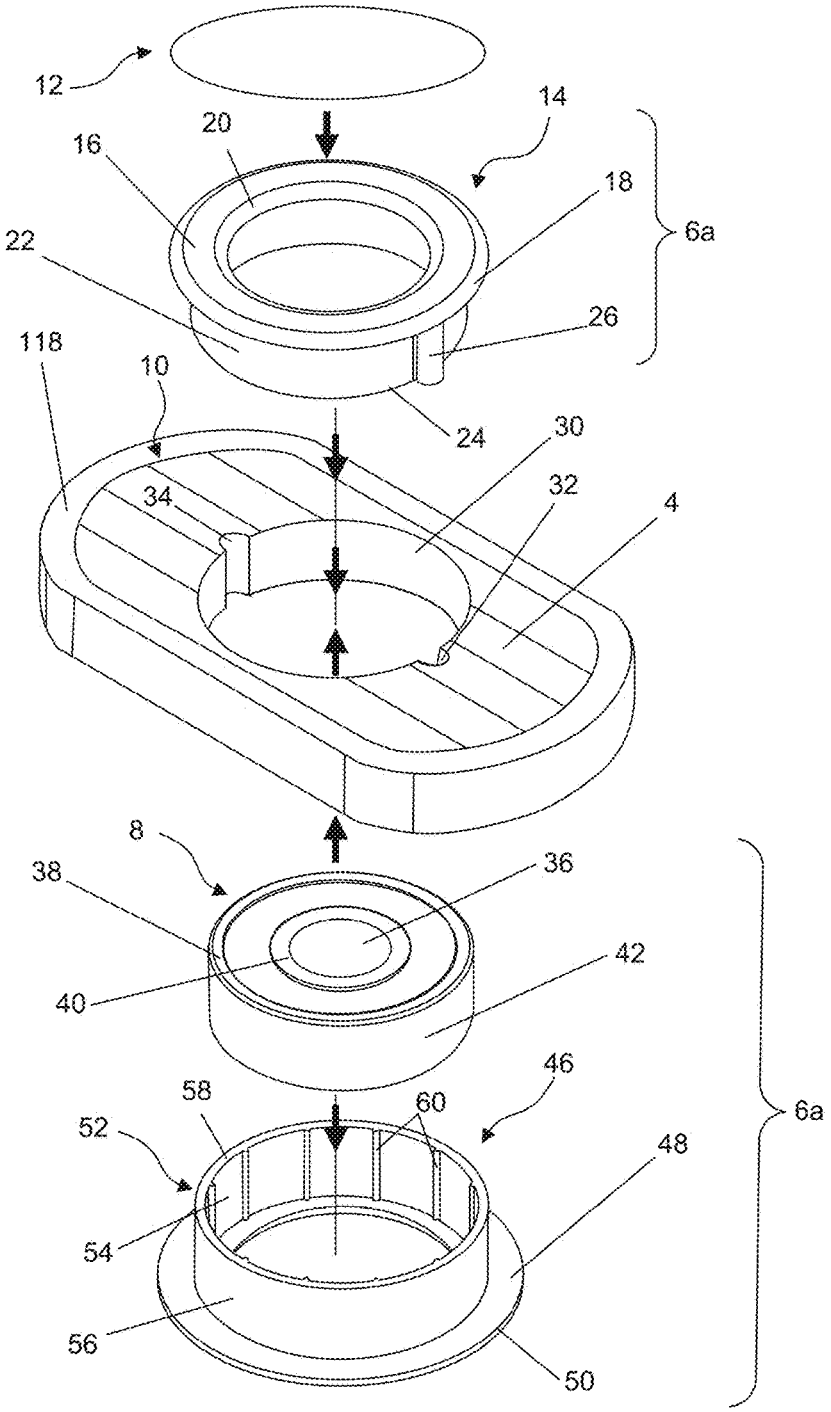
FIG. 2 illustrates an exploded view of a handheld spinner with a stationery item (e.g., eraser) and a cap, according to an embodiment.

With reference to the drawings and in particular to FIGS. 1 and 2 thereof, handheld spinner 2 generally comprises housing 4, holder 6 disposed in aperture 30 of housing 4, ball bearing 8 disposed in holder 6, and one or more stationery items 10 disposed on housing 4, each of which is described in more detail below.

Referring to FIG. 1, housing 4 is a three-dimensional (3D) orthotope or box. Housing 4 has six sides including height faces, length faces, and depth faces. In some embodiments, as shown in FIG. 1, housing 4 has parallel height faces, parallel length faces, and curved depth faces. In some embodiments, for example, housing 4 is a pill shape. In some embodiments, housing 4 can be, for example, a plastic material or other rigid machinable polymer (e.g., polytetrafluoroethylene, polyoxymethylene, phenolics, acetals, nylon, etc.). Housing 4 includes aperture 30 extending through height faces, creating a through hole in housing 4. As shown in FIG. 1, for example, aperture 30 can be a central aperture going through a center of height faces of housing 4. In some embodiments, aperture 30 can be an elliptical shape, for example, aperture 30 can be circular. Housing 4 includes one or more stationery items 10 disposed on housing 4. As shown in FIG. 1, for example, housing 4 includes eraser 118 disposed on an outer perimeter of housing 4, covering length and depth faces. In some embodiments, one or more stationery items 10 can be, for example, and not by way of limitation, pencils, pens, markers, highlighters, crayons, brushes, styluses, stampers, and/or chalk.

Referring to FIG. 2, aperture 30 extends radially outward in housing 4 to form first notch 32 and second notch 34 disposed on an outer circumference of aperture 30 in housing 4. First and second notches 32, 34 are spaced apart by about 180 degrees, aligned along a longitudinal axis of housing 4, and extend through height faces of housing 4. In some embodiments, first and second notches 32, 34 can be disposed anywhere along an outer circumference of aperture 30 in housing 4. In some embodiments, as shown in FIG. 2, first and second notches 32, 34 are cylindrically shaped, for example, hollow semicylinders. In some embodiments, first notch 32 and/or second notch 34 can be optional. For example, aperture 30 can omit first and second notches 32, 34. In some embodiments, first and second notches 32, 34 can be, for example, identical in shape. In some embodiments, first and second notches 32, 34 can be, for example, different in shape.

Referring to FIG. 1, ball bearing 8 is disposed in holder 6. Ball bearing 8 is a standard ball bearing, typical of those used for skateboarding wheels. Referring to FIG. 2, ball bearing 8 includes central ball bearing aperture 36, outer ball bearing cylinder 38 (i.e., outer ring), inner ball bearing cylinder 40 (i.e., inner ring), and outer ball bearing radial wall 42 (i.e., outer ring). Ball bearing 8 and holder 6 are disposed in aperture 30 of housing 4, with ball bearing 8 disposed in holder 6. A user of handheld spinner 2 can grip inner ball bearing cylinder 40 and rotate outer ball bearing radial wall 42, thus, rotating holder 6, housing 4, and one or more stationery items 10 in unison, about a rotational axis through central ball bearing aperture 36. In some embodiments, as shown in FIGS. 2 and 3, holder 6 can be, for example, first holder 6*a* which includes first insert 14 and second insert 46, which are combined to enclose ball bearing 8 and form first holder 6*a*, described in more detail below.

Figure 3:
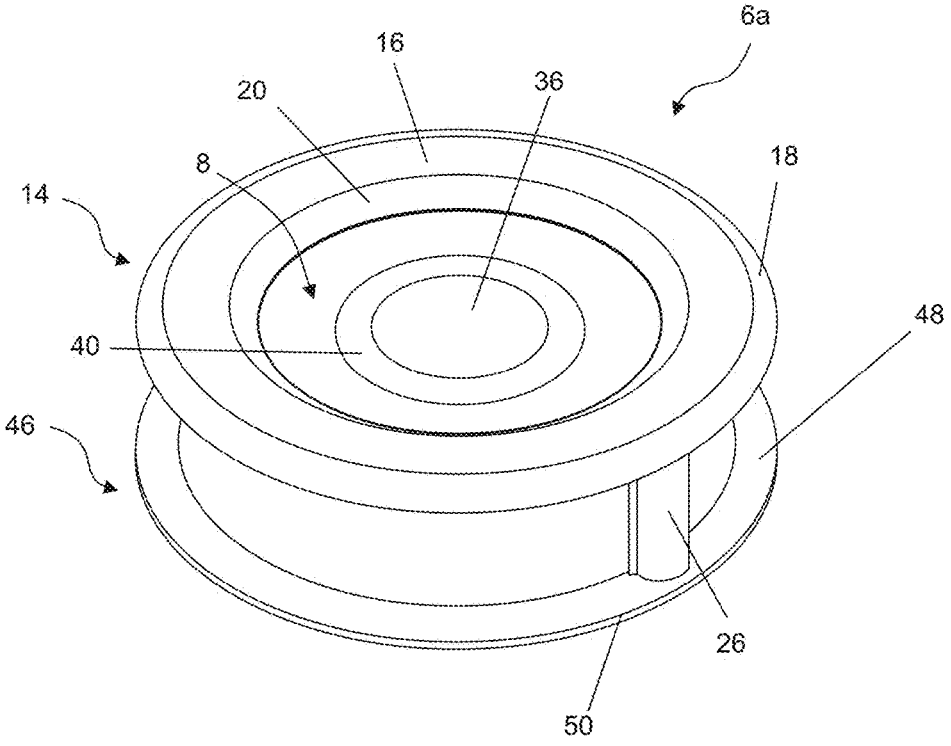
FIG. 3 illustrates a side perspective view of a first holder with a ball bearing between interlocked first and second inserts, according to an embodiment.

Referring to FIGS. 2 and 3, first holder 6*a* is one type of holder 6 that can be used for handheld spinner 2. In some embodiments, ball bearing 8 can be, for example, disposed in first holder 6*a* with interlocking first and second inserts 14, 46. First holder 6*a* is disposed in aperture 30, first notch 32, and second notch 34 of housing 4. As shown in FIGS. 2 and 3, first holder 6*a* is an annulus shape with interlocking first and second inserts 14, 46. In some embodiments, first holder 6*a* can be, for example, a plastic material or other rigid machinable polymer (e.g., polytetrafluoroethylene, polyoxymethylene, phenolics, acetals, nylon, etc.).

Referring to FIGS. 2 and 3, first insert 14 is a hollow cylinder with a top beveled annulus flange. The beveled top annulus flange of first insert 14 includes first flange 16 on top central side of the annulus, adjacent first flange outer bevel 18 on a top outer circumference of the annulus, and adjacent first flange inner bevel 20 on a top inner circumference of the annulus. The hollow cylinder of first insert 14 includes first radial wall 22 and first bottom radial wall 24, with top beveled annulus flange disposed atop first radial wall 22 and first locking nub 26 and second locking nub 28 disposed on an outer surface of first radial wall 22. First and second locking nubs 26, 28 are solid semicylinders, extending along the entire vertical outer face of first radial wall 22, spaced apart by about 180 degrees. First and second locking nubs 26, 28 couple to first and second notches 32, 34, respectively, of aperture 30 of housing 4.

In some embodiments, first and second locking nubs 26, 28 can be cylindrically shaped. In some embodiments, first and second locking nubs 26, 28 can be, for example, identical in shape. In some embodiments, first and second locking nubs 26, 28 can be, for example, different in shape. In some embodiments, first flange outer bevel 18 can be optional, for example, first insert 14 can omit first flange outer bevel 18 and extend first flange 16 to an equivalent outward radial distance. In some embodiments, first flange inner bevel 20 can be optional, for example, first insert 14 can omit first flange inner bevel 20 and extend first flange 16 to an equivalent inward radial distance. In some embodiments, first locking nub 26 and/or second locking nub 28 can be optional, for example, first insert 14 can omit second locking nub 28.

Referring to FIGS. 2 and 3, second insert 46 is a hollow cylinder with a bottom annulus flange. The bottom annulus flange of second insert 46 includes second top flange 48 and second flange bottom 50. The hollow cylinder of second insert 46 includes second radial wall 52 and second top radial wall 58 with bottom annulus flange disposed below second radial wall 52. Second radial wall 52 includes second inner radial wall 54 and second outer radial wall 56. Second inner radial wall 54 includes plurality of ribs 60 disposed circumferentially and equally spaced on second inner radial wall 54. Plurality of ribs 60 are solid semicylinders extending along the entire vertical face of second inner radial wall 54. Plurality of ribs 60 couple to ball bearing 8. Plurality of ribs 60 of second insert 46 secure ball bearing 8 by press fit holding outer ball bearing radial wall 42 when ball bearing 8 is inserted into second insert 46. Second insert 46 interlocks with first insert 14 to form first holder 6*a*. Second outer radial wall 56 of second insert 46 has a smaller diameter than first radial wall 22 of first insert 14, allowing second insert 46 to insert flush into first insert 14, thus interlocking. As shown in FIG. 3, ball bearing 8 is disposed in first holder 6*a* with interlocking first and second inserts 14, 46.

In some embodiments, plurality of ribs 60 can be optional, for example, second inner radial wall 54 can omit plurality of ribs 60. In some embodiments, plurality of ribs 60 can be cylindrically shaped. In some embodiments, plurality of ribs 60 can be, for example, identical in shape. In some embodiments, plurality of ribs 60 can be, for example, different in shape.

Alternatively, referring to FIG. 2, one or more caps 12 can be disposed on ball bearing 8, allowing a user to press down on one or more caps 12 with his/her gripping fingers while still rotating handheld spinner 2 clockwise or counterclockwise about a rotational axis of ball bearing 8. Further, one or more caps 12 protect ball bearing 8 when handheld spinner 2 is not in use, and protect a user's gripping fingers from lubrication or grime on ball bearing 8 when in use. As shown in FIG. 2, cap 12 is a thin circular disc. In some embodiments, one or more caps 12 can be disposed in ball bearing aperture 36. In some embodiments, handheld spinner 2 can include one or more caps 12, for example, a rigid plastic circular cap with a central cylindrical protrusion. For example, one or more caps 12 can be secured on ball bearing 8 by press fit holding one or more caps 12 in central ball bearing aperture 36, discussed in more detail below with reference to FIG. 5. In some embodiments, one or more caps 12 can be optional, for example, handheld spinner 2 can omit cap 12.

Figure 4:
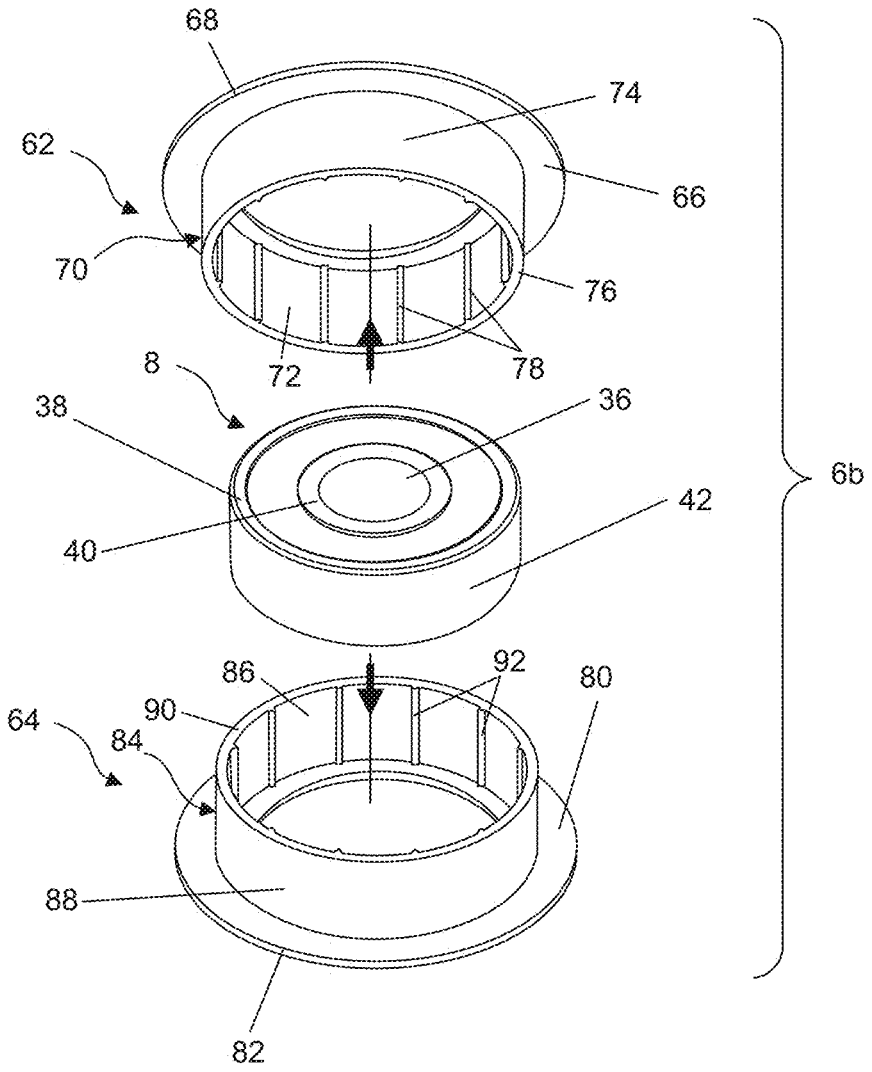
FIG. 4 illustrates an exploded view of a second holder with a ball bearing between symmetric first and second inserts, according to an embodiment.
Figure 5:
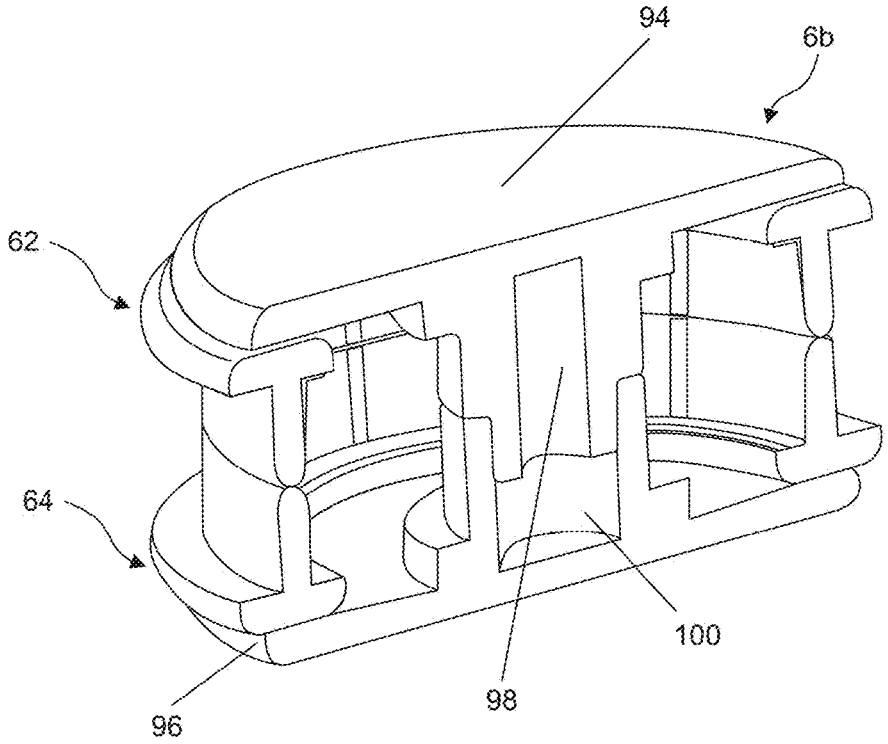
FIG. 5 illustrates a cross-sectional perspective view of a second holder with interlocked upper and lower caps, according to an embodiment.

Referring to FIGS. 4 and 5, second holder 6*b* is one type of holder 6 that can be used for handheld spinner 2. In some embodiments, ball bearing 8 can be, for example, disposed in second holder 6*b* with symmetric first and second inserts 62, 64. As shown in FIGS. 4 and 5, second holder 6*b* is an annulus shape with symmetric first and second inserts 62, 64. In some embodiments, second holder 6*b* can be, for example, a plastic material or other rigid machinable polymer (e.g., polytetrafluoroethylene, polyoxymethylene, phenolics, acetals, nylon, etc.).

Referring to FIGS. 4 and 5, first insert 62 is a hollow cylinder with a top annulus flange. The top annulus flange of first insert 62 includes first bottom flange 66 and first flange top 68. The hollow cylinder of first insert 62 includes first radial wall 70 and first bottom radial wall 76, with top annulus flange disposed atop first radial wall 70. First radial wall 70 includes first inner radial wall 72 and first outer radial wall 74. First inner radial wall 72 includes first plurality of ribs 78 disposed circumferentially and equally spaced on first inner radial wall 72. First plurality of ribs 78 are solid semicylinders extending along the entire vertical face of first inner radial wall 72. First plurality of ribs 78 couple to a top hemisphere of ball bearing 8. First plurality of ribs 78 of first insert 62 secure ball bearing 8 by press fit holding outer ball bearing radial wall 42 when ball bearing 8 is inserted into first insert 62.

In some embodiments, first plurality of ribs 78 can be optional, for example, first inner radial wall 72 can omit first plurality of ribs 78. In some embodiments, first plurality of ribs 78 can be cylindrically shaped. In some embodiments, first plurality of ribs 78 can be, for example, identical in shape. In some embodiments, first plurality of ribs 78 can be, for example, different in shape.

Referring to FIGS. 4 and 5, second insert 64 is a hollow cylinder with a bottom annulus flange. The bottom annulus flange of second insert 64 includes second top flange 80 and second flange bottom 82. The hollow cylinder of second insert 64 includes second radial wall 84 and second top radial wall 90, with bottom annulus flange disposed below second radial wall 84. Second radial wall 84 includes second inner radial wall 86 and second outer radial wall 88. Second inner radial wall 86 includes second plurality of ribs 92 disposed circumferentially and equally spaced on second inner radial wall 86. Second plurality of ribs 92 are solid semicylinders extending along the entire vertical face of second inner radial wall 86. Second plurality of ribs 92 couple to a bottom hemisphere of ball bearing 8. Second plurality of ribs 92 of second insert 64 secure ball bearing 8 by press fit holding outer ball bearing radial wall 42 when ball bearing 8 is inserted into second insert 64. First insert 62 is symmetrically disposed opposite second insert 64 (i.e., mirror image) to form second holder 6*b*. First bottom radial wall 76 of first insert 62 can be flush to second top radial wall 90 of second insert 64, such that first bottom radial wall 76 and second top radial wall 90 contact, allowing first insert 62 and second insert 64 to jointly press fit hold ball bearing 8 inserted therewithin.

In some embodiments, second plurality of ribs 92 can be optional, for example, second inner radial wall 86 can omit second plurality of ribs 92. In some embodiments, second plurality of ribs 92 can be cylindrically shaped. In some embodiments, second plurality of ribs 92 can be, for example, identical in shape. In some embodiments, second plurality of ribs 92 can be, for example, different in shape.

Referring to FIG. 5, one or more caps 12 include upper cap 94 and lower cap 96. Upper and lower caps 94, 96 are thin circular discs with inward cylindrical protrusions 98, 100, respectively, extending from an inner central surface of upper and lower caps 94, 96. Upper cap protrusion 98 includes a further cylindrical extension or post projecting past a centerline of second holder 6*b*. Lower cap protrusion 100 includes a cylindrical recess or notch below a centerline of second holder 6*b*, which couples to upper cap protrusion 98. As shown in FIG. 5, upper cap protrusion 98 couples with lower cap protrusion 100 by press fit holding. Upper and lower caps 94, 96 can be, for example, a plastic material or other rigid machinable polymer (e.g., polytetrafluoroethylene, polyoxymethylene, phenolics, acetals, nylon, etc.). In some embodiments, upper and lower caps 94, 96 can be, for example, plastic circular caps.

In some embodiments, one or more caps 12 can be optional, for example, handheld spinner 2 can omit lower cap 96. In some embodiments, upper and lower caps 94, 96 can be, for example, identical in shape. In some embodiments, upper and lower caps 94, 96 can be, for example, different in shape. In some embodiments, upper and lower caps 94, 96 can be interlocked.

Figure 6:
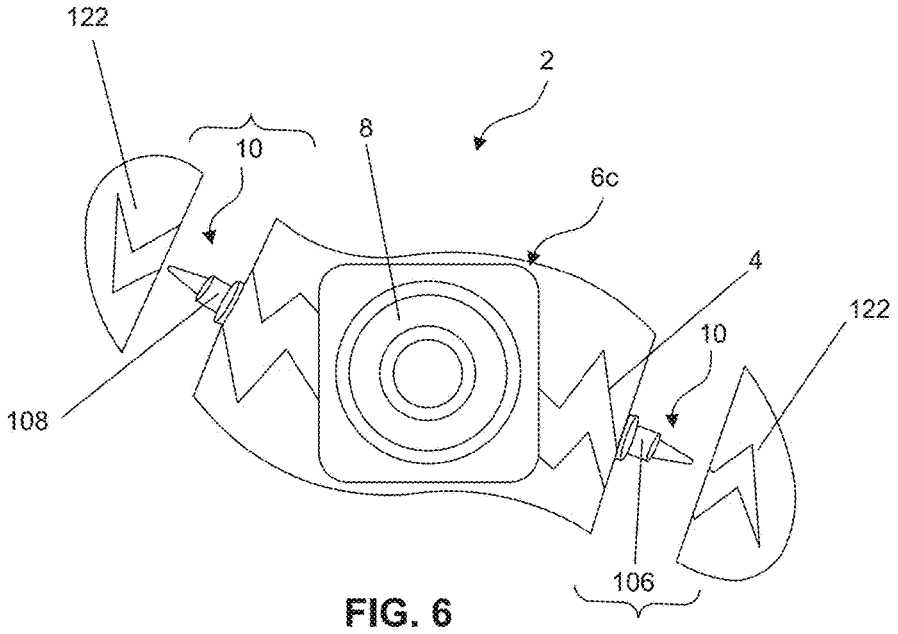
FIG. 6 illustrates a top exploded view of a handheld spinner with two stationery items.
Figure 7:
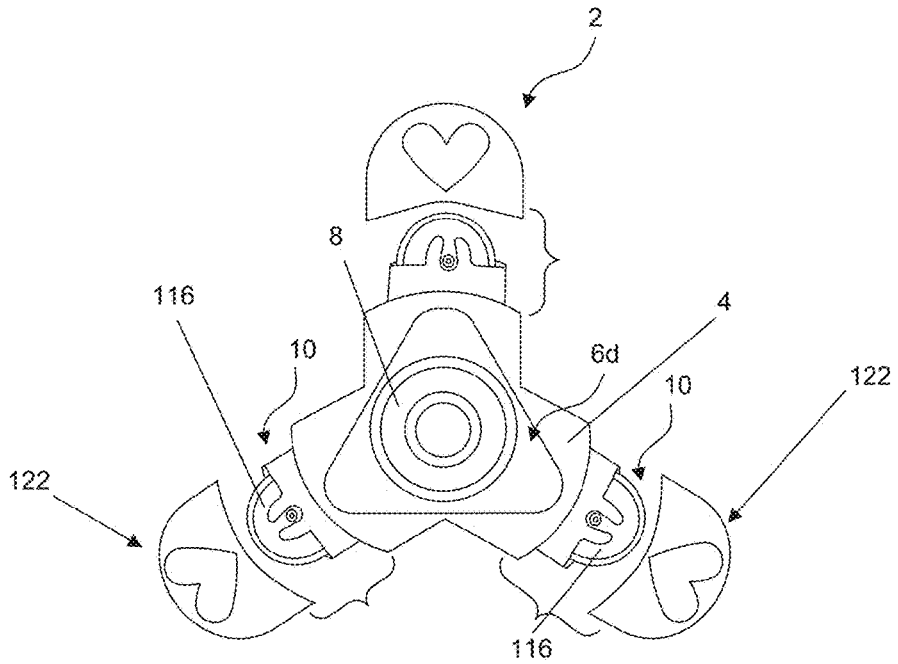
FIG. 7 illustrates a top exploded view of a handheld spinner with three stationery items.
Figure 8:
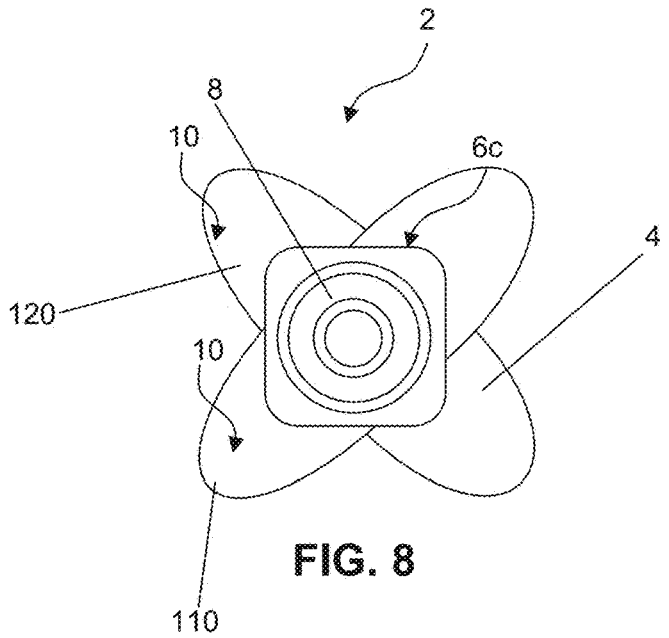
FIG. 8 illustrates a top view of a handheld spinner with four stationery items.
Figure 9:
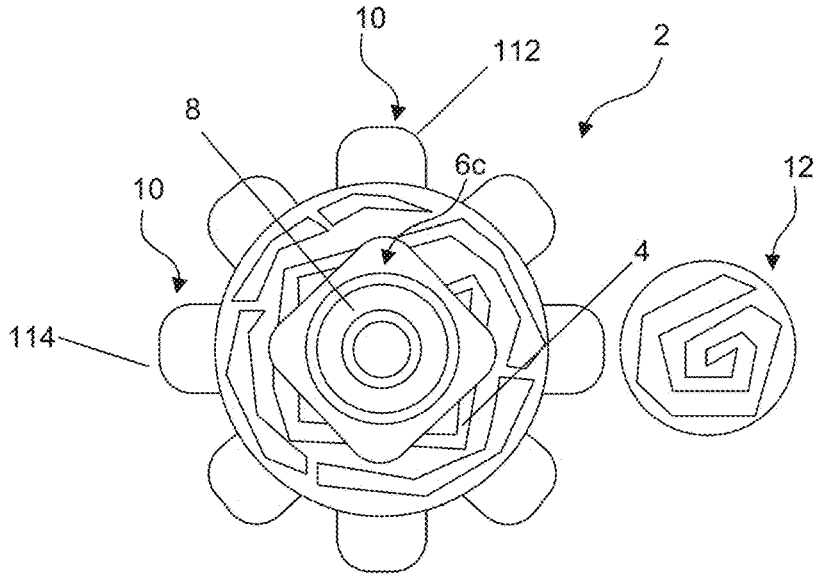
FIG. 9 illustrates a top view of a handheld spinner with eight stationery items.

With reference to the drawings and in particular to FIGS. 6 through 9 thereof, handheld spinner 2 generally comprises housing 4, holder 6 disposed in housing 4, ball bearing 8 disposed in holder 6, one or more stationery items 10 disposed on housing 4, and one or more end caps 122 disposed on respective one or more stationery items 10. FIGS. 6 through 9 illustrate alternative embodiments of handheld spinner 2. As shown in FIGS. 6, 8, and 9, holder 6 is third holder 6*c* which includes interlocking inserts 14, 46 or symmetric inserts 62, 64, described previously. Third holder 6*c* is a quadrilateral shape. As shown in FIG. 7, holder 6 is fourth holder 6*d* which includes interlocking inserts 14, 46 or symmetric inserts 62, 64, described previously. Fourth holder 6*d* is a triangular shape.

Referring to FIG. 6, handheld spinner 2 includes two stationery items 10, marker 106 and highlighter 108, spaced apart by an angle of about 180 degrees and disposed on distal ends of housing 4. Housing 4 is a curved shape resembling an "S"-shape. Handheld spinner 2 includes third holder 6*c* which is square. Handheld spinner 2 includes two end caps 122 which connect and disconnect from marker 106 and highlighter 108. In some embodiments, one or more end caps 122 can be press fit onto respective one or more stationery items 10 on housing 4.

Referring to FIG. 7, handheld spinner 2 includes three stationery items 10, identical stampers 116, spaced apart by an angle of about 120 degrees and disposed on distal ends of housing 4. Housing 4 is a triangular shape resembling a "Y"-shape, with stampers 116 extending outward along distal ends. Handheld spinner 2 includes fourth holder 6*d* which is triangular. Handheld spinner 2 includes three end caps 122 which connect and disconnect from respective stampers 116.

Referring to FIG. 8, handheld spinner 2 includes four stationery items 10, including crayon 110 and chalk 120, spaced apart by an angle of about 90 degrees and disposed on distal ends of housing 4. Housing 4 is a square shape resembling a four-pointed star, with curved edges. Handheld spinner 2 includes third holder 6*c* which is square. In this embodiment, handheld spinner 2 includes no end caps 122.

Referring to FIG. 9, handheld spinner 2 includes eight stationery items 10, including brush 112 and stylus 114, spaced apart by an angle of about 45 degrees and disposed on distal ends of housing 4. Housing 4 is a circular shape resembling a gear with multiple teeth. Handheld spinner 2 includes third holder 6*c* which is square. In this embodiment, handheld spinner includes cap 12. In this embodiment, handheld spinner includes no end caps 122.

In some embodiments, handheld spinner 2 can include housing 4, third holder 6*c*, ball bearing 8, one or more stationery items 10, one or more caps 12, and one or more end caps 122. In some embodiments, handheld spinner 2 can include housing 4, fourth holder 6*d*, ball bearing 8, one or more stationery items 10, one or more caps 12, and one or more end caps 122. In some embodiments, one or more stationery items 10 can be disposed on housing 4. For example, and not by way of limitation, one or more stationery items 10 can include pencils, pens, markers, highlighters, crayons, brushes, styluses, stampers, erasers, and/or chalk. In some embodiments, one or more stationery items 10 can be disposed on housing 4 at regularly spaced intervals (e.g., spaced apart by an angle of 180 degrees, 120 degrees, 90 degrees, 72 degrees, 60 degrees, 45 degrees, 36 degrees, or 30 degrees). In some embodiments, one or more caps 12 are optional and can be omitted. In some embodiments, one or more end caps 122 are optional and can be omitted. In some embodiments, one or more stationery items 10 can be identical stationery items. In some embodiments, one or more stationery items 10 can be different stationery items.

Figure 10A:
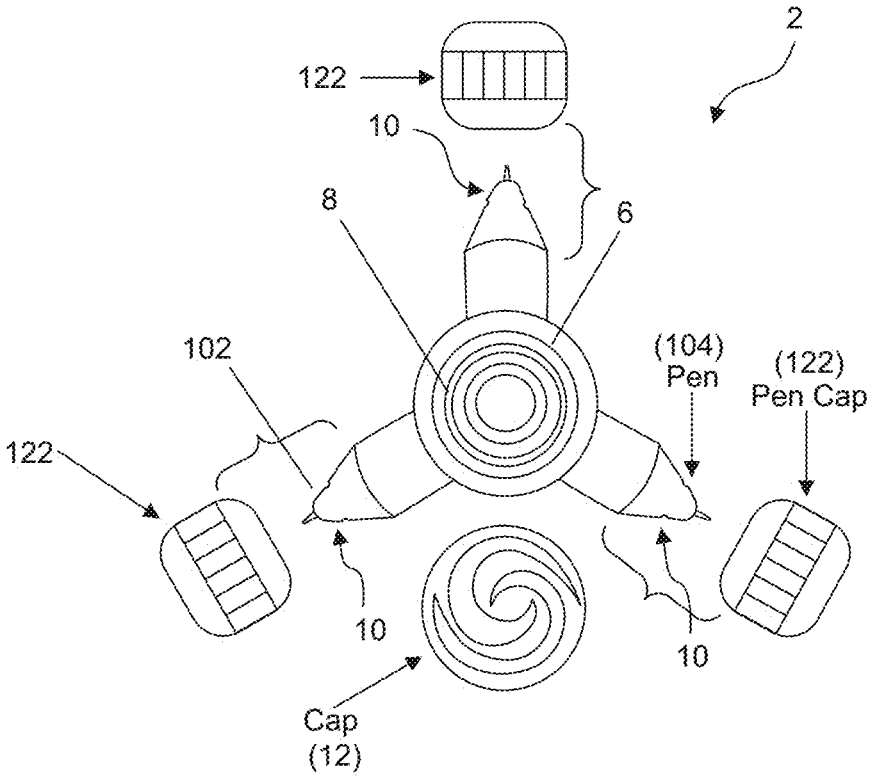
FIG. 10A illustrates a top exploded view of a handheld spinner with three stationery items.
Figure 10B:
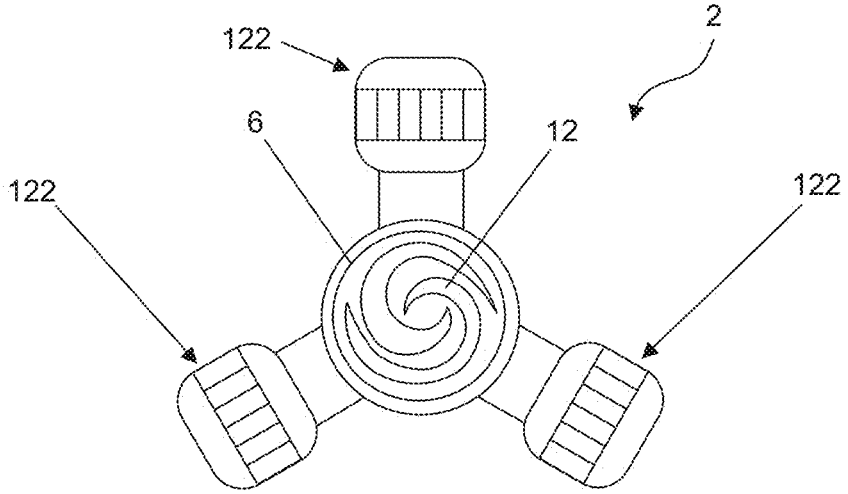
FIG. 10B illustrates a top view of the handheld spinner of FIG. 10A with the cap and end caps secured.
Figure 11:
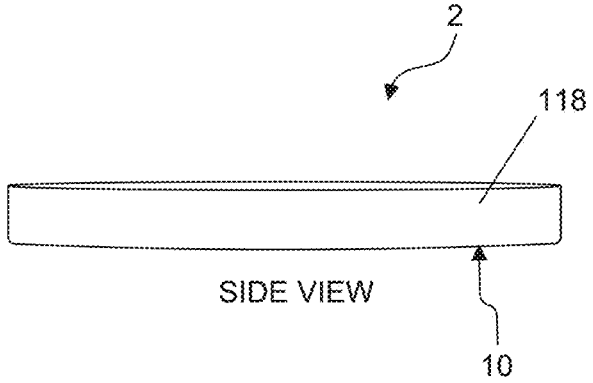
FIG. 11 illustrates a side view of a handheld spinner with a stationery item (e.g., eraser) and no housing, according to an embodiment.

With reference to the drawings and in particular to FIGS. 10 and 11 thereof, handheld spinner 2 generally comprises holder 6, ball bearing 8 disposed in holder 6, one or more stationery items 10 disposed on holder 6, and one or more end caps 122 disposed on respective one or more stationery items 10. FIGS. 10 through 11 illustrate alternative embodiments of handheld spinner 2.

Referring to FIGS. 10A and 10B, handheld spinner 2 includes three stationery items 10, including pencil 102 and pen 104, spaced apart by an angle of about 120 degrees and disposed on distal ends of holder 6, described previously.

Handheld spinner 2 is a triangular shape resembling a "Y"-shape, with pencil 102 and pen 104 extending outward along distal ends of holder 6. Handheld spinner 2 includes three end caps 122 which connect and disconnect from respective three stationery items 10, including pencil 102 and pen 104. In this embodiment, handheld spinner 2 includes cap 12. In this embodiment, handheld spinner 2 includes no housing 4 and stationery items 10 extend directly outward from holder 6. In some embodiments, holder 6 can be flush to one or more stationery items 10. For example, holder 6 can be adjacent to and can match the coloring of one or more stationery items 10. In some embodiments, one or more caps 12 can connect and disconnect to ball bearing 8. As shown in FIG. 10B, for example, cap 12 can be press fit onto ball bearing 8. In some embodiments, one or more end caps 122 can connect and disconnect from one or more stationery items 10. For example, one or more end caps 122 can be press fit onto respective one or more stationery items.

Figure 12:
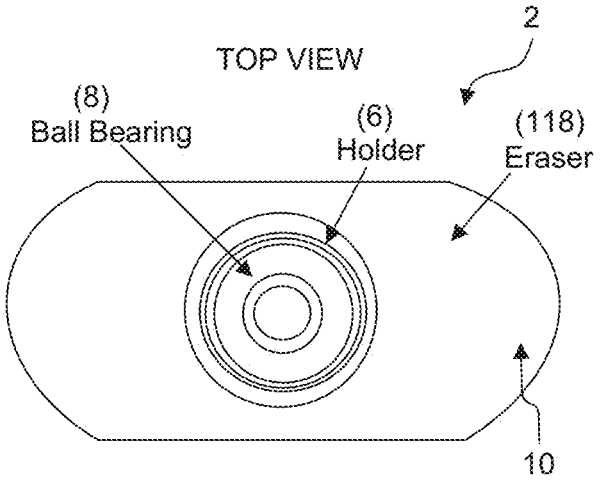
FIG. 12 illustrates a top view of the handheld spinner of FIG. 11.

Referring to FIGS. 11 and 12, handheld spinner 2 includes one stationery item 10, eraser 118, which replaces housing 4 and is the main portion of handheld spinner 2. Handheld spinner 2 is an eraser 118 shape resembling a pill shape. In this embodiment, handheld spinner 2 includes no housing 4, and holder 6 and ball bearing 8 are disposed directly into a central aperture of eraser 118. As shown in FIG. 12, holder 6 is adjacent to eraser 118.

In some embodiments, handheld spinner 2 can include holder 6, ball bearing 8, one or more stationery items 10, one or more caps 12, and one or more end caps 122. In some embodiments, holder 6 can be second holder 6*b*. In some embodiments, holder 6 can be first holder 6*a*. In some embodiments, holder 6 can be third holder 6*c*. In some embodiments, holder 6 can be fourth holder 6*d*. In some embodiments, one or more stationery items 10 can be disposed on holder 6. For example, and not by way of limitation, one or more stationery items 10 can include pencils, pens, markers, highlighters, crayons, brushes, styluses, stampers, erasers, and/or chalk. In some embodiments, one or more stationery items 10 can be disposed on holder 6 at regularly spaced intervals (e.g., spaced apart by an angle of 180 degrees, 120 degrees, 90 degrees, 72 degrees, 60 degrees, 45 degrees, 36 degrees, or 30 degrees). In some embodiments, holder 6 can be flush to one or more stationery items 10. In some embodiments, one or more caps 12 are optional and can be omitted. In some embodiments, one or more end caps 122 are optional and can be omitted. In some embodiments, one or more stationery items 10 can be identical stationery items. In some embodiments, one or more stationery items 10 can be different stationery items.

It is to be appreciated that the Detailed Description section, and not the Brief Summary and Abstract sections, is intended to be used to interpret the claims. The Summary and Abstract sections may set forth one or more but not all exemplary embodiments of the handheld spinner as contemplated by the inventor, and thus, are not intended to limit the present embodiments and the appended claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments, but should be defined only in accordance with the following claims and their equivalents.

What is claimed is:

1. A handheld spinner, comprising:

a housing having a circular aperture disposed in the housing;

a holder including a first insert and a second insert disposed in the circular aperture, wherein the first insert includes a first central aperture, a first radial wall, and a first flange that extends perpendicularly from one end of the first radial wall away from the first central aperture;

wherein the second insert includes a second central aperture, a second radial wall, and a second flange that extends perpendicularly from one end of the second radial wall away from the second central aperture;

a ball bearing disposed within the first and second central apertures and coupled to the first and second radial walls;

and a stationery item disposed on the housing, wherein the stationery item is a plurality of stationery items disposed on the housing.

2. The handheld spinner of claim 1, wherein the stationery item is selected from the group consisting of a pencil, a pen, a marker, a highlighter, a crayon, a brush, a stylus, a stamper, an eraser, and chalk.

3. The handheld spinner of claim 1, wherein the plurality of stationery items are spaced apart by an angle of about N, where N=180 degrees, 120 degrees, 90 degrees, 72 degrees, 60 degrees, 45 degrees, 36 degrees, or 30 degrees.

4. The handheld spinner of claim 3, further comprising a first plurality of ribs formed on the first radial wall for press fit holding the ball bearing in the holder and a second plurality of ribs formed on the second radial wall for press fit holding the ball bearing in the holder, wherein the first insert and the second insert are symmetric.

5. The handheld spinner of claim 3, further comprising a notch formed in the circular aperture and a locking nub formed on the second insert, which is coupled to the locking nub when the holder is disposed in the circular aperture of the housing, wherein the first insert and the second insert are interlocked with each other.

6. A handheld spinner, comprising:

a housing having an aperture disposed in the housing;

a holder having a central aperture, and disposed in the aperture of the housing;

a ball bearing disposed in the central aperture of the holder configured to allow a user to rotate the ball bearing between his or her fingers; and a stationery item, separate from and unconnected to the holder, disposed on the housing and extending along a plane radially perpendicular to the rotational axis of the ball bearing, wherein the stationery item is a plurality of stationery items disposed on the housing.

7. The handheld spinner of claim 6, wherein the holder includes a radial wall.

8. The handheld spinner of claim 7, wherein the holder includes a plurality of ribs formed on the inside of the radial wall for press fit holding the ball bearing.

9. The handheld spinner of claim 7, wherein the holder includes a flange attached to the radial wall that extends from one end of the radial wall and engages with the housing.

10. The handheld spinner of claim 7, wherein the radial wall of the holder includes a locking nub and the aperture disposed in the housing includes a notch, which is coupled to the locking nub when the holder is disposed in the aperture of the housing.

11. The handheld spinner of claim 6, wherein the holder comprises a first insert and a second insert.

12. The handheld spinner of claim 11, wherein the first insert and the second insert are symmetric.

13. The handheld spinner of claim 11, wherein the first insert and the second insert are interlocked with each other.

14. The handheld spinner of claim 6, wherein the stationery item is selected from the group consisting of a pencil, a pen, a marker, a highlighter, a crayon, a brush, a stylus, a stamper, an eraser, and chalk.

15. The handheld spinner of claim 6, wherein the plurality of stationery items are spaced apart by an angle of about N, where N=180 degrees, 120 degrees, 90 degrees, 72 degrees, 60 degrees, 45 degrees, 36 degrees, or 30 degrees.

16. A handheld spinner, comprising:

a stationery eraser for erasing marks created by a writing implement and having an aperture disposed therein;

a holder disposed in the aperture;

a ball bearing disposed in the holder and configured to allow a user to rotate the ball bearing between his or her fingers, and a cap covering a central aperture of the ball bearing.

17. A handheld spinner, comprising:

a holder having a central aperture disposed in the holder;

a ball bearing disposed in the central aperture of the holder configured to allow a user to rotate the ball bearing between his or her fingers;

a writing implement disposed on the holder and extending along a plane radially perpendicular to the rotational axis of the ball bearing; and a cap covering a central aperture of the ball bearing.

18. The handheld spinner of claim 17, wherein the cap includes an upper cap and a lower cap on opposite sides of the ball bearing.

19. The handheld spinner of claim 18, wherein the upper and lower caps interlock with each other.

20. The handheld spinner of claim 17, wherein the cap is press fit into the central aperture of the ball bearing.

21. The handheld spinner of claim 17, wherein the holder is a machinable polymer.

* * * * *